US007047685B2

(12) United States Patent
Diaz et al.

(10) Patent No.: US 7,047,685 B2
(45) Date of Patent: May 23, 2006

(54) FIRE CONTROL ADJUSTMENT SYSTEM

(75) Inventors: Danny D. Diaz, Elizabethtown, KY (US); Vincent B. Norton, Elizabethtown, KY (US)

(73) Assignee: RA Brands, L.L.C., Madison, NC (US)

( * ) Notice: Subject to any disclaimer, the term of this patent is extended or adjusted under 35 U.S.C. 154(b) by 99 days.

(21) Appl. No.: 10/757,108

(22) Filed: Jan. 14, 2004

(65) Prior Publication Data

US 2005/0183311 A1 Aug. 25, 2005

(51) Int. Cl.
*F41A 19/16* (2006.01)

(52) U.S. Cl. ..... 42/69.02

(58) Field of Classification Search ..... 42/69.01, 42/69.02

See application file for complete search history.

(56) References Cited

U.S. PATENT DOCUMENTS 2,126,076 A * 8/1938 Wright et al. ..... 42/69.02
2,249,231 A 7/1941 Smith
2,514,981 A * 7/1950 Walker et al. ..... 42/70.01
2,549,904 A * 4/1951 Hoard ..... 42/69.02
2,557,415 A * 6/1951 Dayton ..... 42/69.01
3,024,559 A * 3/1962 Weatherby ..... 42/70.06
3,755,951 A 9/1973 Koon, Jr.
5,259,137 A 11/1993 Blenk et al. ..... 42/16
6,073,380 A * 6/2000 Hauser et al. ..... 42/70.06
6,681,511 B1 * 1/2004 Huber ..... 42/69.01

FOREIGN PATENT DOCUMENTS

DE 2 305 515 5/1974
WO WO 92/16811 * 10/1992

* cited by examiner

*Primary Examiner*—Stephen M. Johnson
(74) *Attorney, Agent, or Firm*—Womble Carlyle Sandridge & Rice, PLLC

(57) ABSTRACT

An adjustable fire control for firearms having as series of adjustable engagement settings between the sear and the trigger, including a trigger engagement adjustment including a preset engagement and an adjustable engagement for setting the amount of displacement of the trigger with the sear for firing the firearm.

24 Claims, 4 Drawing Sheets

FIRE CONTROL ADJUSTMENT SYSTEM

TECHNICAL FIELD

The present invention relates to a fire control or trigger mechanism for a firearm and more particularly to a trigger mechanism having a series of adjustable engagement settings.

BACKGROUND OF THE INVENTION

A firearm trigger serves the purpose of initiating the firing sequence of the firearm. Typically, upon actuating the trigger, a sear operatively connected thereto is disengaged from locking engagement with a hammer/striker or the firing pin of the firearm, which in turn strikes a round of ammunition within the firing chamber. The sensitivity of the trigger thus is of particular importance in the operation of the firearm. For example, too heavy a trigger pull generally is undesirable since it can lead to jerking of the trigger that can cause shifting or misalignment of the weapon immediately prior to firing and spoil the shooter's aim. On the other hand, too light a trigger pull can raise issues of inadvertent or unintentional discharge of the firearm, especially if dropped or otherwise jarred. Further, with multi-barrel firearms, the trigger pull must not be too light to avoid doubling, that is, an undesirable or unintentional release of a second striker, which can cause the firing of more than one round at the same time.

The trigger and sear generally are calibrated so as to provide an engagement between these parts that should insure a desired trigger pull or response. However, because of normal manufacturing tolerances, this engagement can vary from sharp to loose. This variation or looseness is described as trigger "take-up". In addition, after extended use, further looseness or take-up can develop in the engagement between the trigger bar and the sear. Such "take-up" or looseness in the action of the trigger is undesirable from a user's standpoint since the accuracy of the shot depends in large measure on the responsiveness of the trigger, and thus the sharper the trigger response, the more accurate the marksmanship.

Some shooters accordingly will try to sharpen or adjust the responsiveness of the trigger to their own preferences, though often to such an extent that the firearm becomes unsafe without their realizing that the newly adjusted trigger setting poses a danger. Since the area of engagement between the trigger and the sear is such a small amount, typically between about 0.024 inches to 0.027 inches, measuring a setting typically requires the use of an optical comparator, and therefore, it is difficult for the user to determine the resulting new settings upon adjustment and the dangers that may result from a setting that is too small. Thus, resetting the firearm to the original factory setting or determining if the setting is safe generally is not possible for the ordinary user.

Thus, what is needed is an apparatus that enable easy and concise adjustment of various operating parameters of a firearm trigger assembly to a desired user setting to "sharpen" the trigger up to a minimum safe level of operation.

SUMMARY

Briefly described, in accordance with the present invention, there is provided a fire control assembly or trigger mechanism for firearms having a series of adjustments for adjusting various engagements or operative settings of the components of the trigger mechanism for adjusting or "sharpening" the responsiveness and function or operation of the trigger mechanism to suit user preferences, while maintaining proper operation of the trigger mechanism. The trigger mechanism of the present invention generally includes a moveable trigger mounted within a trigger housing and a sear adapted to engage the trigger for preventing movement of the firing pin or a hammer/striker of the firearm in which the present trigger mechanism is mounted. The trigger is biased toward a non-engaged, rest position in which it blocks movement of the sear out of engagement with the firing pin until the trigger is moved during a firing operation to fire a round of ammunition from the firearm.

The trigger mechanism of the present invention further includes a series of adjustment mechanisms for adjusting approximately five different operational features of the trigger mechanism. Among the adjustment mechanisms are an over-travel adjustment and a trigger pull adjustment. The over-travel adjustment helps set or fix the amount of rearward movement of the trigger after sear or hammer release, while the trigger pull adjustment adjusts the force required to move the trigger to a position to release the sear. The over-travel and trigger pull adjustment mechanisms typically include setscrews, pins, or other similar devices that are received within the bores formed within the trigger housing. The position of the setscrews or pins is adjustable by engagement of a tool, such as a screwdriver or similar tool, into a head portion thereof for moving the adjustment screws longitudinally along their respective bores.

In addition, a minimum and maximum trigger engagement adjustment is provided, which includes a first or outer sleeve or screw that projects through a forward portion of the trigger. Typically, the maximum trigger engagement adjustment is set or fixed at the factory to provide a maximum trigger engagement or safety limit for the trigger mechanism. A minimum trigger engagement screw or pin will further be received within the outer sleeve or first engagement screw and will be adjustably moveable therealong to set a minimum trigger engagement for the trigger mechanism. Lastly, a trigger block adjustment will be provided for adjusting the travel or engagement between a safety and a rear arm portion of the trigger. The trigger block adjustment typically will include a set screw or pin received in the rear arm of the trigger, with its position with respect to the safety generally being factory set and can be fixed against further adjustment.

Various objects, features and advantages of the present invention will become apparent to those skilled in the art upon a review of the following detailed description, when taken in conjunction with the accompanying drawings.

DESCRIPTION OF THE PREFERRED EMBODIMENT

Figure 1:
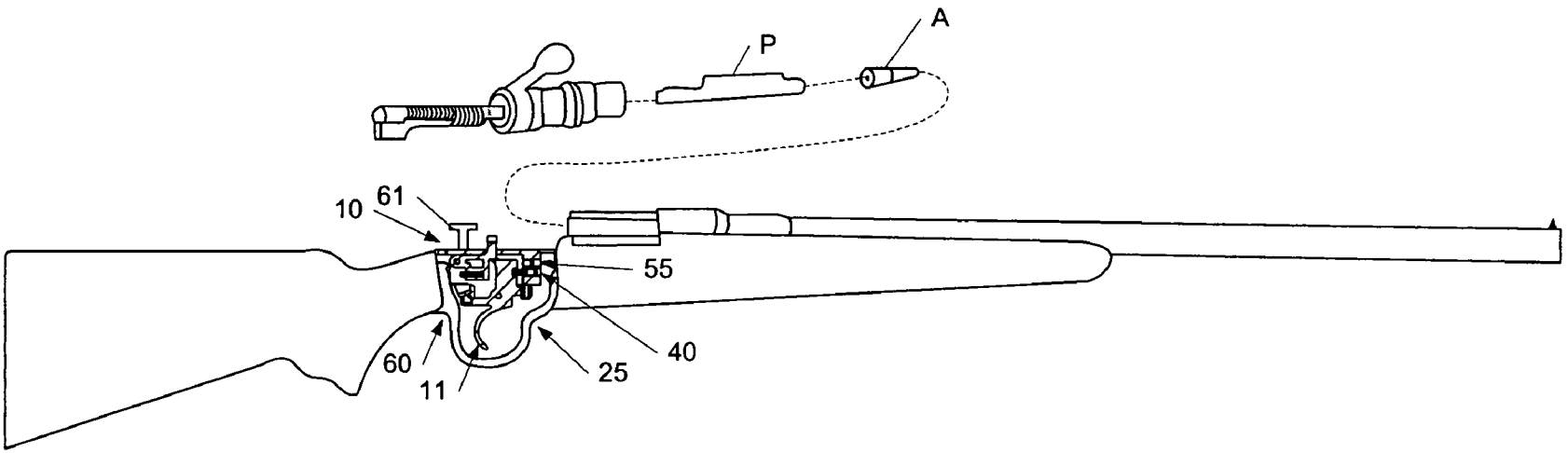
FIG. 1 illustrates the trigger assembly in combination with a firearm.

Referring now to the drawings in which like numerals indicate like parts throughout the several views, FIGS. 1–4 illustrate the adjustable fire control or trigger mechanism 10 of the present invention, particularly for use in a firearm F. The trigger mechanism 10 includes a series of five adjustable engagement settings or adjustments for "sharpening" or varying the responsiveness or action of the trigger 11 of the trigger mechanism as needed for ease of repair and maintenance and/or to suit a user's preference. Further, while the firearm F has been shown in FIG. 1 as a bolt action rifle, it will be understood by those skilled in the art that the trigger mechanism 10 of the present invention also can be used with various other types of firearms, including various types of rifles, shotguns and other long guns, as well as handguns.

Figure 2:
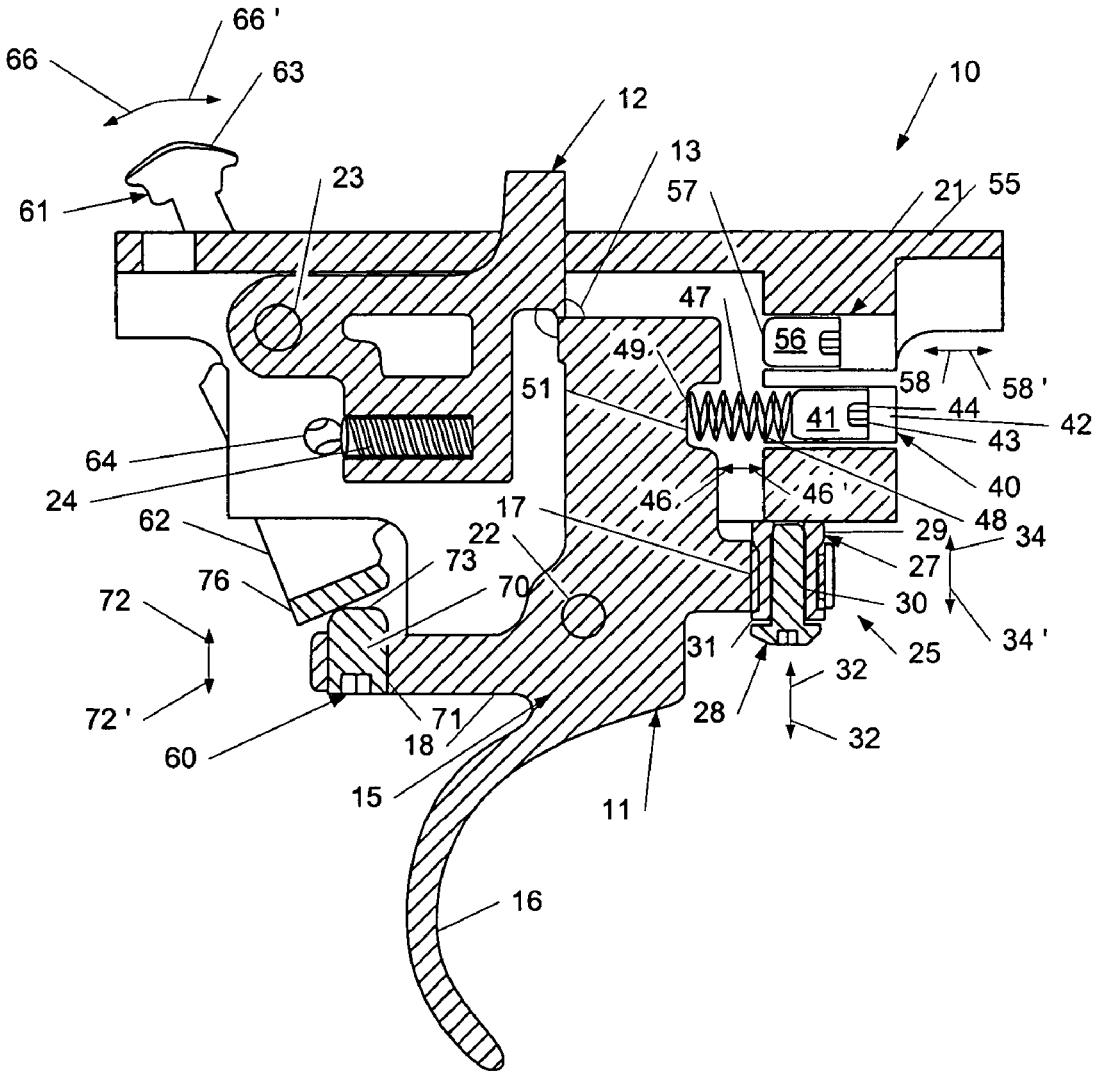
FIG. 2 illustrates a cross-sectional view of the trigger mechanism of the present invention.
Figure 3:
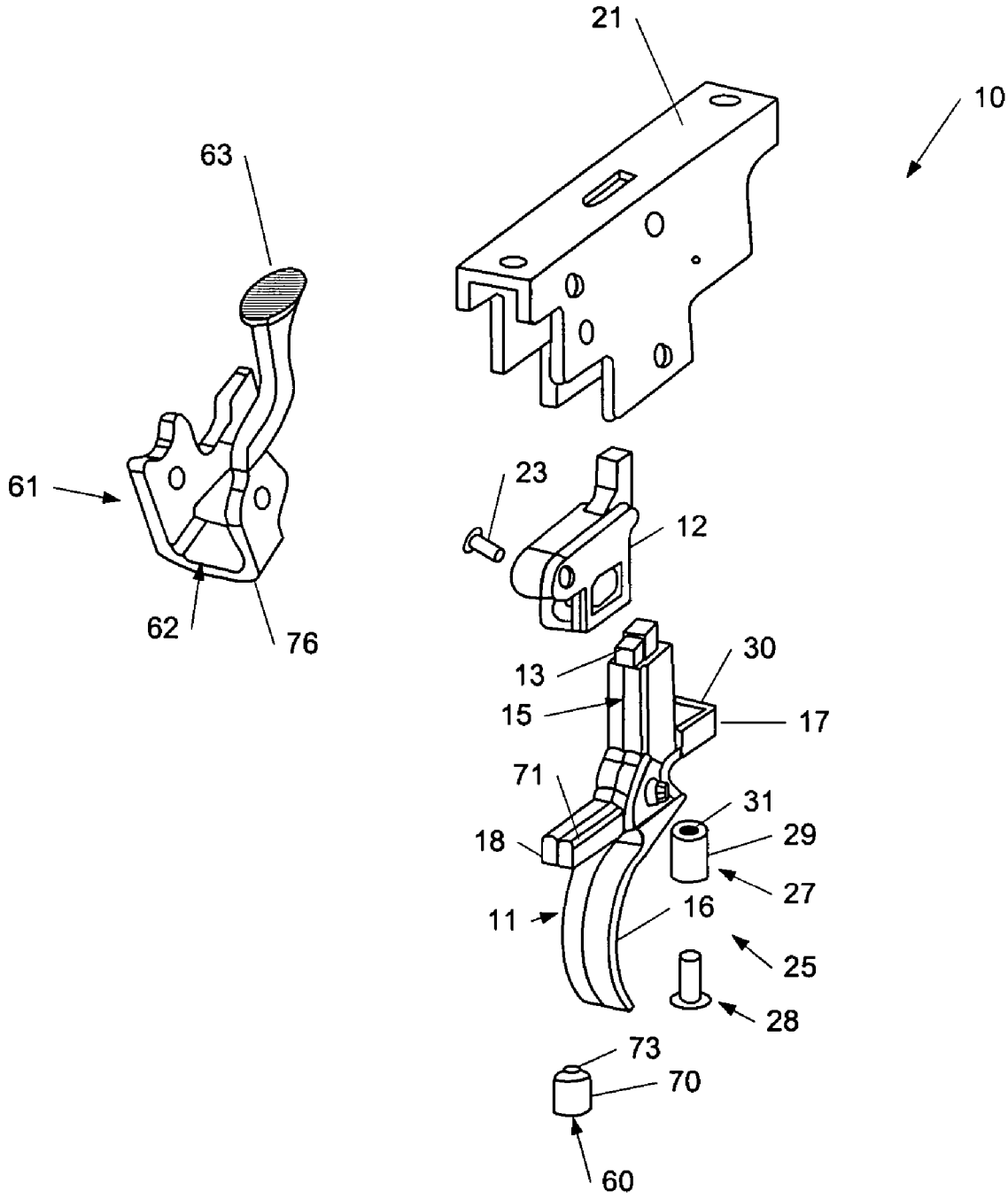
FIG. 3 is an expanded view of the trigger of the present invention.
Figure 4:
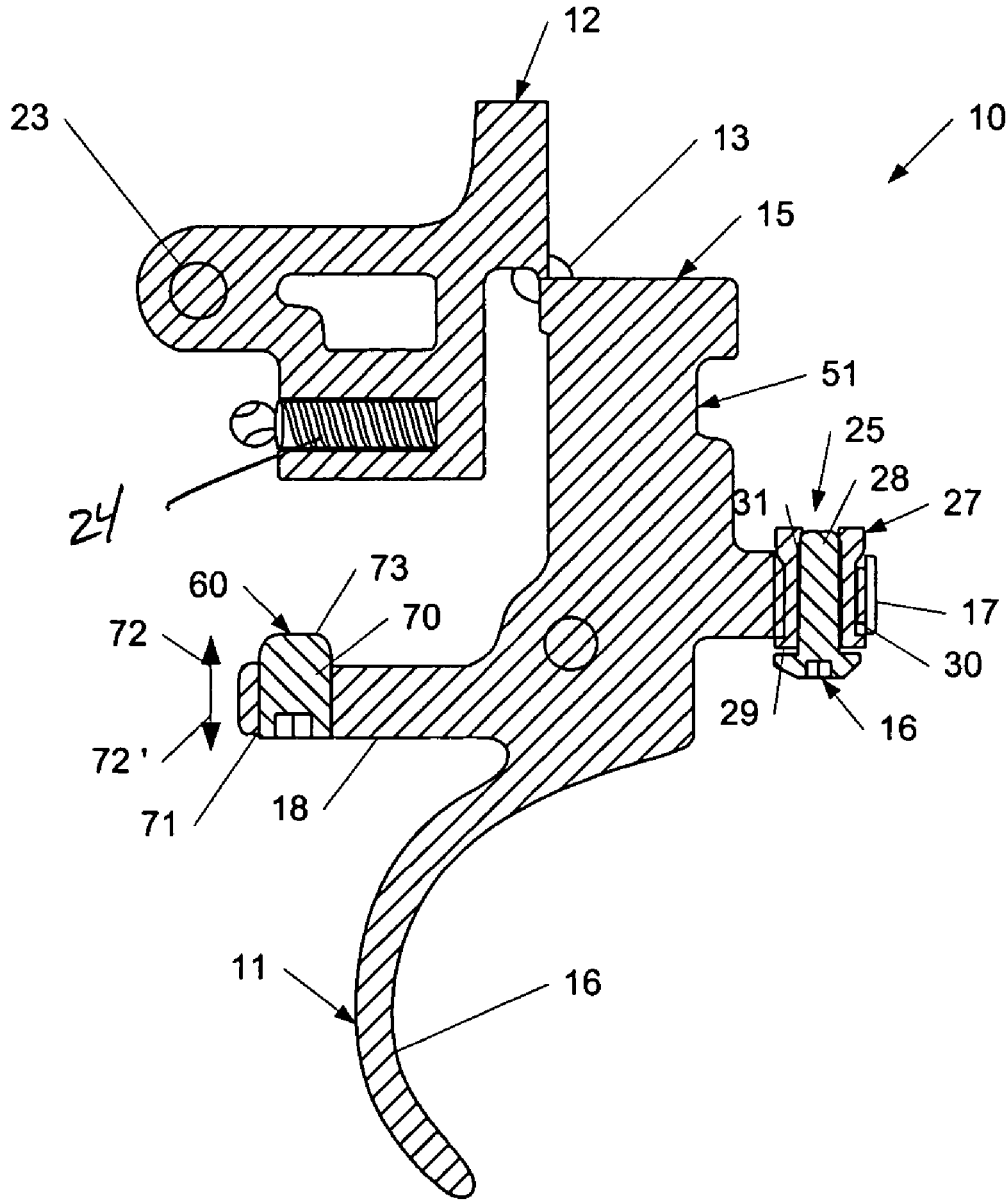
FIG. 4 is a side elevational view showing the engagement between the trigger and the sear.

As generally indicated in FIGS. 2–4, among the trigger mechanism adjustments that can be performed with the trigger mechanism 10 of the present invention are an overtravel adjustment for setting the amount of movement of the trigger away from the sear upon firing; a trigger pull adjustment for adjusting the sensitivity or amount of force that is required to move the trigger and release a sear 12 for firing the firearm F; a trigger engagement adjustment including both a maximum and minimum engagement adjustment to set the amount of interference or spacing between the trigger 11 and sear 12, or the amount the trigger has to move at the engagement surface between the trigger and sear to release the sear and fire the firearm; and a safety engagement or trigger block adjustment as indicated in FIG. 2.

As indicated in FIGS. 2–4, the trigger 11 generally engages the sear 12 at a point of engagement or area of contact 13 between of the trigger and the sear with the amount or distance of the point or area of contact generally known as the engagement setting. The engagement setting is typically measured in thousandths of an inch, with radial displacement of the trigger thus resulting in reduction of such engagement setting. A reduced engagement setting "sharpens" the trigger. In the present invention, the trigger engagement setting includes a pre-set setting and a variable or adjustable engagement setting. The preset engagement generally is factory set to a predetermined maximum engagement setting that may not be altered by a user. The variable engagement setting allows the user to adjust the engagement setting to a minimum engagement setting, which generally is limited to a predetermined range or limit.

Turning now to the drawings, FIGS. 2–4 generally illustrate the fire control or trigger mechanism 10 of the present invention in cross-sectional and exploded perspective views. The trigger mechanism 10 includes the trigger 11 having a trigger body 15 that generally is formed from a metal such as steel or other high strength, durable material. The trigger body includes a integrally formed user engagement grip portion 16 projecting downwardly therefrom, as well as a forward trigger arm portion 17 and a rear trigger arm portion 18. The trigger 11 typically is housed in a trigger housing 21, which generally is formed from a similar high strength material such as steel, other metals, or other similar materials, with the trigger 11 pivotally connected to the trigger housing 21 by a pivot pin 22.

As indicated in FIG. 2, the sear 12 also generally is pivotally mounted within the trigger housing 21 such as by a pivot pin 23, and typically is biased into a raised position as shown in FIG. 2 by a spring 24. The trigger 11 is adapted to engage the sear 12 at an upper end of the trigger body at the point of engagement 13 (FIGS. 2 and 4). The sear is in turn adapted to engage a firing pin P (FIG. 1), which the sear releases upon movement of the trigger so that the firing pin will engage or strike a round of ammunition A to initiate the firing of the round of ammunition.

As depicted in FIGS. 2–4, a trigger engagement adjustment assembly or mechanism 25 is provided along the forward arm portion 17 of the trigger 11, and includes a pre-set or maximum engagement adjustment 27 and a variable or minimum engagement adjustment 28. The maximum engagement adjustment 27 generally is depicted in FIGS. 2 and 3 as a cylinder or sleeve 29 that resides within a bore 30 formed along the forward trigger arm portion 17, although it will also be understood that this sleeve 29 further can be integrally formed within the forward trigger arm portion or attached at the distal or free end thereof. The sleeve 29 of the maximum engagement adjustment 27 includes a bore or channel 31 extending therethrough, which generally can be threaded to accept the variable or minimum engagement adjustment 28.

The minimum or variable engagement adjustment 28 generally can include a setscrew, pin or similar device that is received within, and is moveable vertically along the bore or channel 31 of the sleeve 29 in the direction of arrows 32 and 32'. The variable engagement adjustment 28 may be secured within the sleeve 29 so as to prevent loss of the variable engagement adjustment screw or similar device 28, and further may be restricted to permit only adjustments within a predetermined safe setting range for the trigger engagement setting. Still further, while the variable engagement adjustment 28 generally is shown as a setscrew or other threaded fastener received within a sleeve or cylinder, other adjustment mechanisms other than a threaded screw and/or sleeve also can be used as long as such adjustment mechanisms enable a substantially precise and consistent adjustment of the trigger engagement setting.

As further indicated in FIGS. 2 and 4, the interaction or point of engagement 13 between the sear 12 and trigger body 13 is set by the adjustment or movement of the trigger engagement adjustment mechanism 25. Generally, the trigger engagement setting or area of contact between the sear and trigger is contemplated to be between approximately 0.01 inch up to approximately 0.035 inch, although this engagement setting may further be varied to include greater or lesser amounts of engagement as needed or desired, depending upon the performance characteristics desired for the firearm F in which the trigger mechanism or fire control 10 of the present invention is being used. Typically, a maximum trigger engagement setting will be set between approximately 0.022 inches and about 0.03 inches or greater. This maximum engagement setting is generally set at the factory during or after manufacture of the fire control or assembly of the firearm by movement or adjustment of the sleeve 29 of the preset engagement adjustment 27 in the direction of arrows 34 or 34' (FIG. 2) along the bore or channel 30 within the forward trigger arm portion 17. Once set, the maximum engagement adjustment sleeve generally will be fixed in place by the factory, such as by applying a sealing or resin material, such as "lock-tight".

Thereafter, the trigger engagement setting for the trigger assembly further can be adjusted down to a minimum engagement setting of typically approximately 0.01 inches by adjustment or movement of the variable engagement adjustment 28. The variable engagement adjustment 28 generally is designed to be moved in the direction of arrows 32 and 32' along the bore or inner channel of the sleeve 29 so as to permit reduction of the trigger engagement setting generally by about 50%, up to approximately 100% of the preset or maximum engagement setting, with a minimum value of the variable engagement setting generally being fixed at or around approximately 0.01 inches for safety considerations.

As further illustrated in FIG. 2, a trigger pull adjustment mechanism 40 is provided adjacent the upper end of the trigger body 15. The trigger pull adjustment is designed to enable adjustment of the amount of force that must be applied to the trigger to move the trigger and release it from engagement with the sear 12, generally includes an adjustment screw, pin, or similar device 41 received within a bore or channel 42 formed within the trigger housing 21. Typically, the bore or channel 42 of the trigger housing will be a threaded bore adapted to receive the adjustment screw 41 therealong. The adjustment screw further typically includes a head portion 43 having a recess 44 formed therein in which a tool such as a screwdriver, key or jig can be inserted to engagement and cause movement of the set screw along the bore 42 in the direction of arrows 46 and 46'.

A spring 47 generally is received within the rear end of the bore 42, with a first or proximal end 48 of the spring being at least partially received within the bore 42 so as to be engaged by the setscrew 41. A second or distal end 49 of the spring is received in recess 51 formed within the trigger body 15 so as to secure the distal end of the spring against lateral or vertical movement. As the set screw 41 is moved in the direction of arrow 46 along its bore 42, it causes compression of the spring 47, while conversely, moving the set screw in the direction of arrow 46' releases the compression on the spring. As a result, as the compression of the spring is increased, the amount of force required to move the trigger during a trigger pull is correspondingly increased, while releasing the compression on the spring lightens or reduces the amount of force needed for a trigger pull so the trigger pull can be varied due to user preference for reduction of lock time and sharper response of the trigger. The trigger adjustment further can be fixed with a minimum trigger pull amount so as to limit the adjustment of the trigger pull by a user to within a predefined range.

FIG. 2 further illustrates the over travel adjustment provided by the fire control of the present invention, which includes an over travel adjustment mechanism 55 within an upper portion of the trigger housing 21. The over-travel adjustment mechanism adjusts the amount or extent of movement of the trigger during a trigger pull, and thus it is returned to engagement with the sear. The over-travel adjustment 55 generally includes a setscrew or similar adjustment device or mechanism 56 that is received within a bore 57 formed through a portion of the trigger housing 21. The bore 57 typically is threaded so as to enable the relatively precise adjustment or movement of the setscrew 56 of the over-travel adjustment mechanism 55 in the direction of arrows 58 and 58' toward or away from engagement with an upper end of the trigger body 15 as indicated in FIG. 2.

Additionally, there is provided a trigger block adjustment 60 for adjusting or setting the engagement between the trigger and a safety mechanism 61 upon actuation of the safety mechanism to prevent movement of the trigger. The trigger block adjustment mechanism 60 generally is provided or mounted within the rear arm portion 18 of the trigger body 15, as shown in FIGS. 2 and 4, although it also can be integrally formed with the rear arm portion of the trigger body or fixedly attached to the distal end thereof. As FIGS. 2 and 3 indicate, the safety mechanism 61 generally includes a safety arm or saddle 62 having a lever or engaging portion 63 at its upper end that typically projects outwardly from the stock and receiver of the firearm as indicated in FIG. 1, for engagement by the user. The safety arm is pivotally mounted to an upper end of the trigger housing 21 (FIG. 2) such as by pivot pin 64, so as to pivotable in the direction of arrows 66 and 66' between a non-engaging position and a lowered, engaged position, which engages the trigger block adjustment mechanism 60 and prevents further rearward movement of the trigger 11.

The trigger block adjustment mechanism 60 is shown here as including a set screw 70 that is received within a bore 71 formed within the rear trigger arm portion 18, although it will also be understood that other types of similar adjustment devices also can be used. The set screw 70 generally is adjustable by threaded movement thereof along the bore 71 in the direction of arrows 72 and 72' so as to adjust the distance at which a head portion 73 of the set screw 70 projects above the rear trigger arm portion 18 to a desired point at which a lower portion 76 of the safety arm 62 will be engaged at a tight point of contact to ensure substantially minimal or no movement of the trigger upon engagement of the safety mechanism 61.

By providing such varying adjustments of the trigger assembly or fire control mechanism, the present invention enables the manufacture of various component parts of the trigger mechanism such as the safety and trigger with a wider range of manufacturing tolerances, instead of requiring a highly precise fit between the safety mechanism and trigger, which thus enables a lower cost to manufacture such parts, while still providing a precise, tight engagement between the safety mechanism and trigger of the fire control. Further, once set, the trigger block adjustment typically will be permanently affixed, such as by welding or the use of a sealing material such as a resin, such as lock-tight, or other similar material. It is also possible to allow the trigger block adjustment to remain unfixed, as needed or desired for maintenance or other adjustment of the fire control mechanism after extensive use.

Although the present invention has been described with various embodiments, it is understood that the modifications and variations may be utilized without departing from the spirit and scope of the invention, as those skilled in the art will readily understand. Such modifications and variations are considered to be within the purview and scope of the appended claims and their equivalents.

What is claimed is:

1. A fire control for firearms comprising:

a trigger, wherein the trigger comprises a body having a user engagement portion projecting downwardly therefrom, a front trigger arm and a rear trigger arm, and wherein the rear trigger arm includes a trigger block adjustment adapted to engage a safety;

a sear adapted to engage the trigger at a point of engagement, wherein the point of engagement between the sear and trigger can be adjusted to a desired engagement setting; and a series of adjustments for adjusting a series of desired operation engagement settings for the trigger, including a trigger engagement adjustment, comprising a minimum and a maximum engagement adjustment to control the lateral displacement of the trigger out of engagement with the sear, wherein the trigger engagement adjustment comprises an engagement sleeve and an adjustable engagement screw threadably coupled within a cylinder.

2. The fire control of claim 1, wherein a minimum engagement adjustment setting for the trigger engagement adjustment is about 0.010 inches.

3. The fire control of claim 1, wherein the sear is adapted to release a firing pin for discharging a round of ammunition when the trigger is pulled.

4. A fire control for firearms comprising:

a trigger;

a sear adapted to engage the trigger at a point of engagement, wherein the point of engagement between the sear and trigger can be adjusted to a desired engagement setting; and a series of adjustments for adjusting a series of desired operation engagement settings for the trigger, including a trigger engagement adjustment, comprising a minimum and a maximum engagement adjustment to control the lateral displacement of the trigger out of engagement with the sear, wherein the trigger engagement adjustment comprises an engagement sleeve and an adjustable engagement screw threadably coupled within a cylinder, and wherein the engagement sleeve is permanently affixed within the trigger.

5. A fire control for firearms comprising:

a trigger, wherein the trigger comprises a body having a user engagement portion projecting downwardly therefrom, a front trigger arm and a rear trigger arm, and wherein the rear trigger arm includes a trigger block adjustment adapted to engage a safety;

a sear adapted to engage the trigger at a point of engagement, wherein the point of engagement between the sear and trigger can be adjusted to a desired engagement setting; and a series of adjustments for adjusting a series of desired operation engagement settings for the trigger, including a trigger engagement adjustment, comprising a minimum and a maximum engagement adjustment to control the lateral displacement of the trigger out of engagement with the sear, wherein the adjustments further comprise an over-travel adjustment, and a trigger pull adjustment.

6. A fire control for firearms comprising:

a trigger, wherein the trigger comprises a body having a user engagement portion projecting downwardly therefrom, a front trigger arm and a rear trigger arm, and wherein the rear trigger arm includes a trigger block adjustment adapted to engage a safety;

a sear adapted to engage the trigger at a point of engagement, wherein the point of engagement between the sear and trigger can be adjusted to a desired engagement setting; and a series of adjustments for adjusting a series of desired operation engagement settings for the trigger, including a trigger engagement adjustment, comprising a minimum and a maximum engagement adjustment to control the lateral displacement of the trigger out of engagement with the sear, wherein a maximum trigger engagement adjustment setting for the trigger engagement adjustment comprises between about 0.022 inches and about 0.035 inches.

7. The fire control of claim 6, wherein a minimum trigger engagement adjustment setting for the trigger engagement adjustment is between about 50% and about 100% of the maximum trigger engagement adjustment setting.

8. A fire control for firearms comprising:

a trigger, wherein the trigger comprises a body having a user engagement portion projecting downwardly therefrom, a front trigger arm and a rear trigger arm, and wherein the rear trigger arm includes a trigger block adjustment adapted to engage a safety;

a sear adapted to engage the trigger at a point of engagement, wherein the point of engagement between the sear and trigger can be adjusted to a desired engagement setting; and a series of adjustments for adjusting a series of desired operation engagement settings for the trigger, including a trigger engagement adjustment, comprising a minimum and a maximum engagement adjustment to control the lateral displacement of the trigger out of engagement with the sear, wherein the trigger block adjustment comprises a screw threadably engaging the rear trigger arm for adjusting an engagement distance setting between the trigger block adjustment and the safety.

9. A firearm comprising:

a barrel;

a fire control mechanism including a trigger and a sear adapted to engage the trigger at a point of contact;

wherein the fire control mechanism comprises a series of adjustments including a trigger pull adjustment, an over-travel adjustment for the trigger, and a trigger engagement adjustment comprising a preset engagement setting and a variable engagement setting for controlling an amount of movement between the trigger and the sear required to release the sear from engagement with the trigger to fire the firearm;

a firing pin adapted to be released by the sear for engaging a round of ammunition when the trigger is pulled; and a safety adapted to block operation of the fire control mechanism upon actuation.

10. The firearm of claim 9 wherein the trigger further comprises a trigger body, a front trigger arm, and a rear trigger arm including an adjustable trigger block mechanism mounted therewithin and adapted to engage the safety of the firearm.

11. The firearm of claim 10, wherein the trigger block mechanism comprises a set-screw threadably connected to the rear trigger arm.

12. The firearm of claim 9 wherein the trigger engagement adjustment comprises an engagement sleeve and an engagement screw threadably coupled with in a cylinder.

13. The firearm of claim 12, wherein the engagement sleeve is adjusted to a desired preset setting and thereafter is permanently affixed within the cylinder.

14. The firearm of claim 9, wherein the preset engagement setting is between about 0.022 inches and about 0.035 inches.

15. The firearm of claim 14, wherein the variable engagement setting is between about 50% and about 100% of the preset engagement setting.

16. The firearm of claim 9, wherein a minimum value of the variable engagement setting is about 0.010 inches.

17. A method of setting a firearm fire control, the method comprising:

providing a firearm comprising:

a trigger;

a sear adapted to engage the trigger at a point of engagement; and a trigger engagement adjustment mechanism comprising an engagement sleeve axially translatable within the trigger, and an adjustable engagement element threadably engaged within the engagement sleeve, the trigger adjustment mechanism being adapted to control the engagement of the trigger with the sear;

adjusting the position of the engagement sleeve within the trigger to a first engagement setting, wherein the first engagement setting provides a first engagement of the trigger with the sear; and adjusting the position of the engagement element within the adjustment sleeve to a second engagement setting, wherein the second engagement setting provides a second engagement of the trigger with the sear.

18. The method of claim 17, wherein adjusting the position of the engagement sleeve to the first engagement setting comprises adjusting the position of the engagement sleeve so that the first engagement between the trigger and the sear is between about 0.022 inches and about 0.035 inches.

19. The method of claim 18, wherein adjusting the position of the engagement element to the second engagement setting comprises variably adjusting the position of the engagement element so that the second engagement between the trigger and the sear is between about 50% and about 100% of the first engagement between the trigger and the sear.

20. The method of claim 18, wherein adjusting the position of the engagement element to the second engagement setting comprises variably adjusting the position of the engagement element so that the second engagement between the trigger and the sear has a minimum value of about 0.010 inches.

21. The method of claim 17, wherein the trigger further comprises a trigger body and a front trigger arm, the engagement sleeve being disposed within the front trigger arm.

22. The method of claim 17, wherein adjusting the position of the engagement sleeve to the first engagement setting comprises adjusting the position of the engagement sleeve so that the first engagement between the trigger and the sear is at a maximum value.

23. The method of claim 22, wherein adjusting the position of the engagement element to the second engagement setting comprises variably adjusting the position of the engagement element so that the second engagement between the trigger and the sear is between about 50% and about 100% of the maximum value.

24. The method of claim 17, further comprising fixing the adjustment sleeve within the trigger after adjusting the position of the engagement sleeve to the first engagement setting.

* * * * *